US010393130B2

(12) United States Patent
Benjamin et al.

(10) Patent No.: US 10,393,130 B2
(45) Date of Patent: Aug. 27, 2019

(54) SYSTEMS AND METHODS FOR REDUCING FRICTION DURING GAS TURBINE ENGINE ASSEMBLY

(71) Applicant: United Technologies Corporation, Hartford, CT (US)

(72) Inventors: Daniel Benjamin, Simsbury, CT (US); Kaliya Balamurugan, Newington, CT (US); Daniel R. Kapszukiewicz, Plainfield, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 751 days.

(21) Appl. No.: 15/017,216

(22) Filed: Feb. 5, 2016

(65) Prior Publication Data

US 2017/0227014 A1 Aug. 10, 2017

(51) Int. Cl.

| | |
|---|---|
| ***F04D 29/054*** | (2006.01) |
| ***F04D 29/64*** | (2006.01) |
| ***F01D 5/02*** | (2006.01) |

(52) U.S. Cl.

CPC ..... *F04D 29/054* (2013.01); *F01D 5/025* (2013.01); *F01D 5/026* (2013.01); *F04D 29/644* (2013.01); *F05D 2220/3219* (2013.01); *F05D 2230/60* (2013.01)

(58) Field of Classification Search

CPC . F01D 5/06; F01D 5/066; F01D 5/025; F01D 5/026; F04D 29/054; F04D 29/644; F05D 2220/3219; F05D 2230/60

See application file for complete search history.

(56) References Cited

U.S. PATENT DOCUMENTS

| | | | | |
|---|---|---|---|---|
| 5,537,814 | A | 7/1996 | Nastuk et al. | |
| 8,517,687 | B2 * | 8/2013 | Benjamin | F01D 5/066 416/198 A |
| 8,794,923 | B2 | 8/2014 | Tirone | |
| 9,121,280 | B2 | 9/2015 | Benjamin | |
| 2011/0219781 | A1 | 9/2011 | Benjamin | |
| 2013/0266421 | A1 | 10/2013 | Benjamin | |
| 2014/0017087 | A1 | 1/2014 | Benjamin | |
| 2016/0230560 | A1 * | 8/2016 | Tucker | F01D 5/066 |

FOREIGN PATENT DOCUMENTS

| | | |
|---|---|---|
| EP | 2186997 | 5/2010 |
| EP | 2365184 | 9/2011 |

OTHER PUBLICATIONS

EP Search Report dated Jun. 19, 2017 in EP Application No. 17154650.0.

* cited by examiner

*Primary Examiner* — Justin D Seabe
*Assistant Examiner* — Julian B Getachew
(74) *Attorney, Agent, or Firm* — Snell & Wilmer, L.L.P.

(57) ABSTRACT

Systems and methods for reducing friction during gas turbine engine assembly may comprise, a rear hub which may comprise a conical web, a horizontal arm coupled to the conical web, and/or a hub kickstand coupled to the conical web. The conical web, horizontal arm, and/or hub kickstand may converge at a pivot point. The hub kickstand may be removably coupled to the tie shaft.

6 Claims, 4 Drawing Sheets

SYSTEMS AND METHODS FOR REDUCING FRICTION DURING GAS TURBINE ENGINE ASSEMBLY

BACKGROUND

During gas turbine engine assembly, the tie shaft is stretched as part of the preload process for the rotors stack. The amount of stretching force applied to the tie shaft to achieve the required preloading of rotors stack typically must be augmented to compensate for friction between the tie shaft and a rear hub. The amount of friction may be inconsistent and difficult pre-determine. To avoid applying "extra" stretch force to the tie shaft, it may be beneficial to reduce the friction between the tie shaft and the rear hub during gas turbine engine assembly.

SUMMARY

In various embodiments, a gas turbine engine may comprise a high pressure compressor comprising a rotor, a rear hub, and/or a tie shaft. The rear rub may comprise a conical web, which may be coupled to the rotor, a horizontal arm coupled to the conical web, and/or a hub kickstand coupled to the conical web. The conical web, horizontal arm, and/or hub kickstand may converge at a pivot point. The hub kickstand may be removably coupled to the tie shaft. In various embodiments, the rear hub may comprise a stiffening member coupled to the conical web.

In various embodiments, the hub kickstand may comprise a hub foot, which may couple to the tie shaft. The tie shaft may comprise a tie shaft snap, which may couple to the hub foot. The tie shaft snap may comprise a shape that is complementary to the shape of the hub foot. The hub kickstand and/or hub foot may be configured to be decoupled from the tie shaft in response to an axial compression force applied to the horizontal arm. The conical web may be configured to bend in response to an axial compression force applied to the horizontal arm.

In various embodiments, a method for assembling a gas turbine engine may comprise, coupling a high pressure compressor rotor to a conical web of a rear hub, removably coupling a tie shaft to a hub kickstand of the rear hub, applying an axial compression force to a horizontal arm of the rear hub, displacing a pivot point of the rear hub in response to the axial compression force, and/or decoupling the hub kickstand from the tie shaft. The hub kickstand and/or the horizontal arm may be coupled to the conical web. The pivot point may be a point on the rear hub at which the conical web, the horizontal arm, and/or the hub kickstand converge. The hub kickstand may comprise a hub foot that may be coupled and decoupled from the tie shaft.

In various embodiments, the method for assembling a gas turbine engine may further comprise stretching the tie shaft, bending the conical web in response to applying axial compression force to the horizontal arm, ceasing the axial compression force to the horizontal arm, and/or fixedly coupling the tie shaft to the hub kickstand. The fixedly coupling the tie shaft to the hub kickstand may be completed with a coupling nut.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

As used herein, "aft" refers to the direction associated with the tail (e.g., the back end) of an aircraft, or generally, to the direction of exhaust of the gas turbine engine. As used herein, "forward" refers to the direction associated with the nose (e.g., the front end) of an aircraft, or generally, to the direction of flight or motion.

Figure 1:
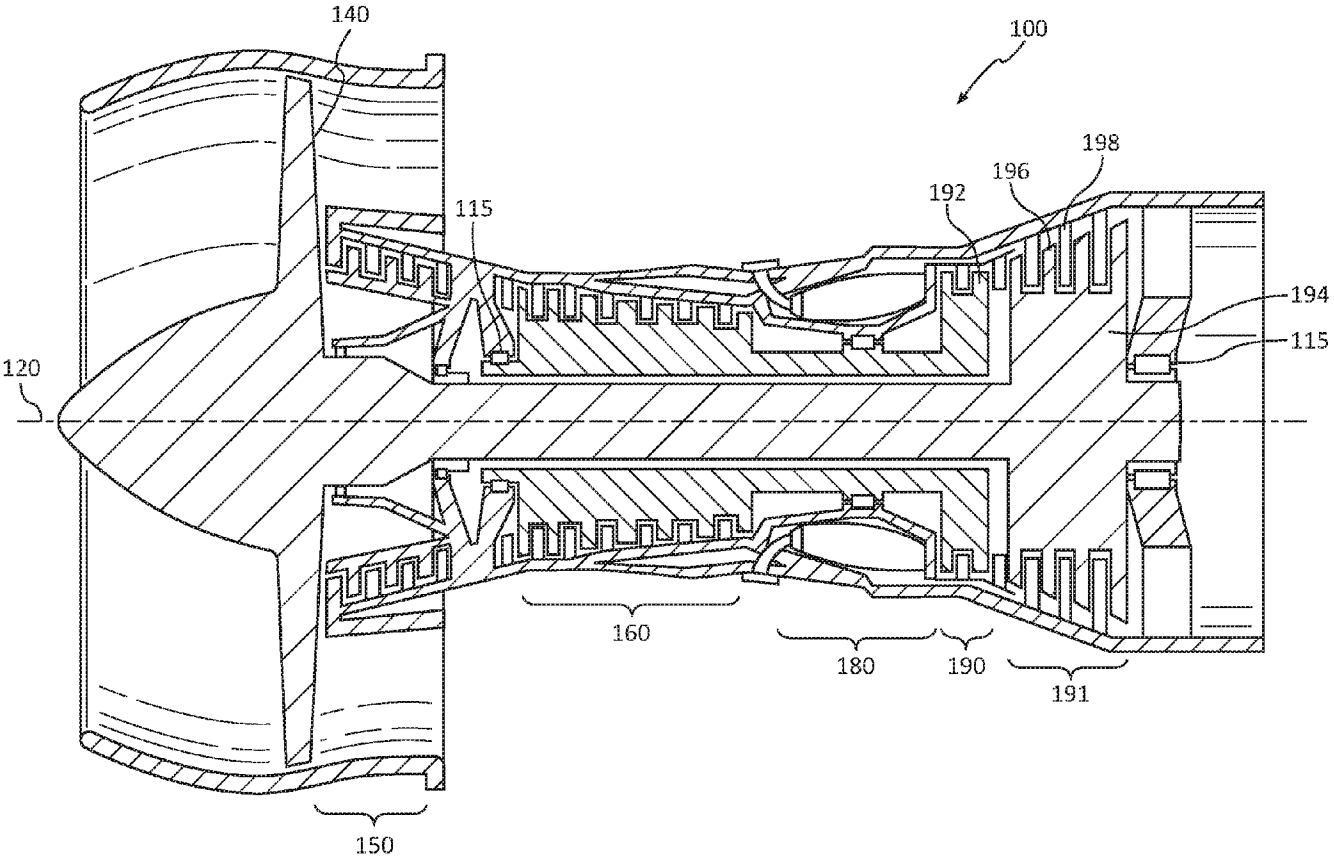
FIG. 1 illustrates a schematic cross-section view of a gas turbine engine, in accordance with various embodiments.

Referring to FIG. 1, a gas turbine engine 100 (such as a turbofan gas turbine engine) is illustrated according to various embodiments. Gas turbine engine 100 is disposed about axis of rotation 120. Gas turbine engine 100 may comprise a fan 140, compressor sections 150 and 160, a combustion section 180, and turbine sections 190, 191. Air compressed in compressor sections 150, 160 may be mixed with fuel and burned in combustion section 180 and expanded across turbine sections 190, 191. Turbine sections 190, 191 may include high pressure rotors 192 and low pressure rotors 194, which rotate in response to the expansion. Turbine sections 190, 191 may comprise alternating rows of rotary airfoils or blades 196 and static airfoils or vanes 198. A plurality of bearings 115 may support spools in gas turbine engine 100. FIG. 1 provides a general understanding of the sections in a gas turbine engine, and is not intended to limit the disclosure. The present disclosure may extend to all types of turbine engines, including turbofan gas turbine engines, geared turbofan engines, and turbojet engines, for all types of applications.

The forward-aft positions of gas turbine engine 100 lie along axis of rotation 120. For example, fan 140 may be referred to as forward of turbine sections 190, 191, and turbine sections 190, 191 may be referred to as aft of fan 140. Typically, during operation of gas turbine engine 100, air flows from forward to aft, for example, from fan 140 to turbine sections 190, 191. As air flows from fan 140 to the more aft components of gas turbine engine 100, axis of rotation 120 may also generally define the direction of the air stream flow.

Figure 2A:
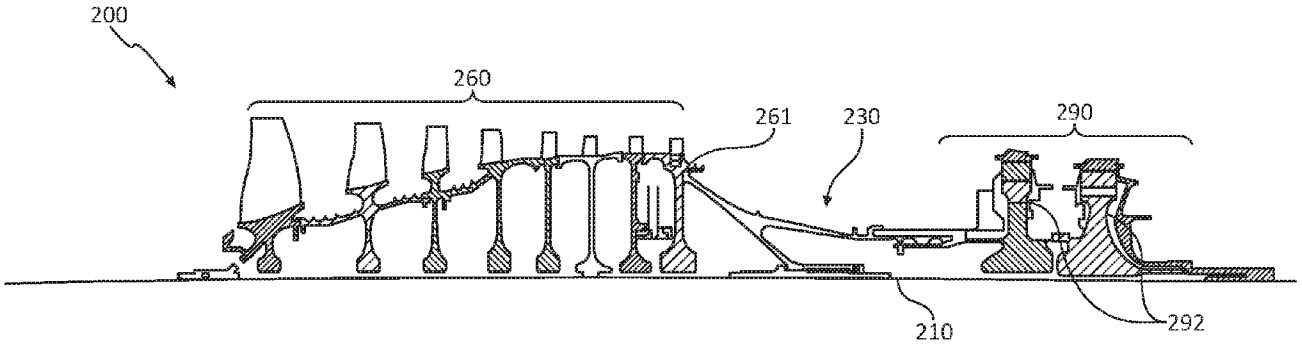
FIG. 2A illustrates a cross-sectional view of a high pressure compressor, a rear hub, and a high pressure turbine in a gas turbine engine, in accordance with various embodiments.

Referring to FIG. 2A, a system 200 in a gas turbine engine comprising a high pressure compressor (HPC) 260, a rear hub 230, and a high pressure turbine (HPT) 290 is illustrated, according to various embodiments. Elements with the like element numbering as depicted in FIG. 1, are intended to be the same and will not be repeated for the sake of clarity. HPC 260 may comprise rotors in a rotors stack disposed axially within HPC 260, such as an aft-most HPC rotor 261. In various embodiments, rear hub 230 may be coupled to and between HPC 260 and HPT 290. HPC 260 may be forward of rear hub 230 in the gas turbine engine. HPT 290, and HPT rotors 292, may be aft of rear hub 230 in the gas turbine engine. HPC 260, rear hub 230, and/or HPT 290 may be coupled to a tie shaft 210.

Figure 2B:
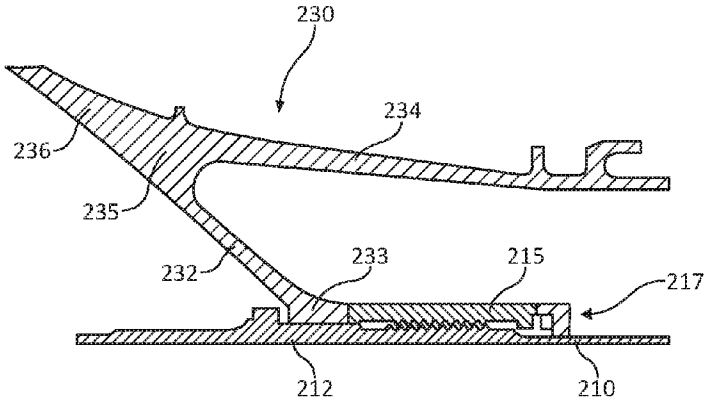
FIG. 2B illustrates a cross-sectional view of a rear hub in a gas turbine engine, in accordance with various embodiments.

FIG. 2B depicts rear hub 230 in accordance with various embodiments. Rear hub 230 may be coupled to tie shaft 210. With combined reference to FIGS. 2A and 2B, in various embodiments, rear hub 230 may comprise a conical web 236, a horizontal arm 234, and/or a hub kickstand 232. Horizontal arm 234 and/or hub kickstand 232 may be coupled to conical web 236. Conical web 236, horizontal arm 234, and/or hub kickstand 232 may couple to each other by converging at a pivot point 235. In various embodiments, the horizontal arm may be coupled to the hub kickstand. In various embodiments, conical web 236 may be coupled to HPC 260, for example, at aft-most HPC rotor 261. In various embodiments, a rotor in the HPC may be mounted directly to the rear hub and/or be integral with the rear hub. Horizontal arm 234 may be coupled to HPT 290.

In various embodiments, hub kickstand 232 may be removably coupled to tie shaft 210. In various embodiments, hub kickstand 232 may comprise a hub foot 233, which may removably couple to tie shaft 210. Tie shaft 210 may comprise a tie shaft snap 212, which may have a shape that is complementary to hub foot 233, wherein hub foot 233 may be removably coupled to tie shaft 210. Hub foot 233 may snap into or otherwise be disposed adjacent to tie shaft 210 and/or tie shaft snap 212. In various embodiments, a coupling nut 215 may be used to fixedly couple hub kickstand 232 and/or hub foot 233 to tie shaft 210 and/or tie shaft snap 212 through. A lock 217 may be coupled to the tie shaft 210, and may be configured to hold hub kickstand 232, hub foot 233, and/or coupling nut 215 in place adjacent to tie shaft 210.

Figure 3A:
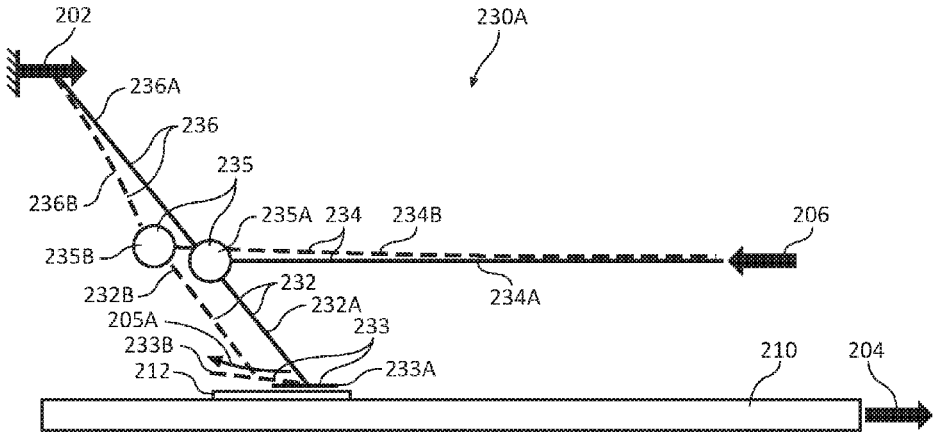
FIG. 3A illustrates a schematic view of a rear hub in a gas turbine engine, in accordance with various embodiments.

Referring to FIG. 3A, a schematic view of a rear hub in a gas turbine engine is depicted, in accordance with various embodiments. Elements with the like element numbering as depicted in FIGS. 2A and 2B, are intended to be the same and will not be repeated for the sake of clarity. As depicted in FIG. 3A, in response to an axial compression force 206 applied to horizontal arm 234, rear hub 230A and its components may be displaced and/or bend. Absent axial compression force 206, pivot point 235 may be in position 235A. When pivot point 235 is in position 235A, horizontal arm 234 may be in position 234A, hub kickstand 232 may be in position 232A, hub foot 233 may be in position 233A, and/or conical web 236 may be in position 236A. Hub foot 233 may be coupled to, and/or in physical contact with, tie shaft snap 212 when in position 233A.

In various embodiments, in response to axial compression force 206 being applied to horizontal arm 234, a static force 202 may react to conical web 236. Static force 202 may be a resistance force resulting from HPC 260 remaining static despite axial compression force 206 being applied. The components of rear hub 230A may move in a forward direction in response to axial compression force 206. In response to rear hub 230A and its components moving in a forward direction, pivot point 235 may move axially and/or radially, and assume position 235B. In response to pivot point 235 being displaced into position 235B, horizontal arm 234 may assume position 234B, which may comprise horizontal arm 234 bending and/or moving radially and/or axially. In various embodiments, in response to pivot point 235 assuming position 235B, hub kickstand 232 may be displaced axially and/or radially and assume position 232B, and hub foot 233, which may be rigidly coupled to hub kickstand 232, may move axially and/or radially and assume position 233B, moving in lifting direction 205A and separating from tie shaft snap 212. Hub foot 233, when in position 233B, may be decoupled from tie shaft 210 and/or tie shaft snap 212, and/or may be partially or completely separated from tie shaft 210 and/or tie shaft snap 212. In various embodiments, conical web 236 may move axially and/or radially, and may be displaced into position 236B in response to pivot point 235 assuming position 235B. When in position 236B, conical web 236 may assume an arcuate shape.

Figure 3B:
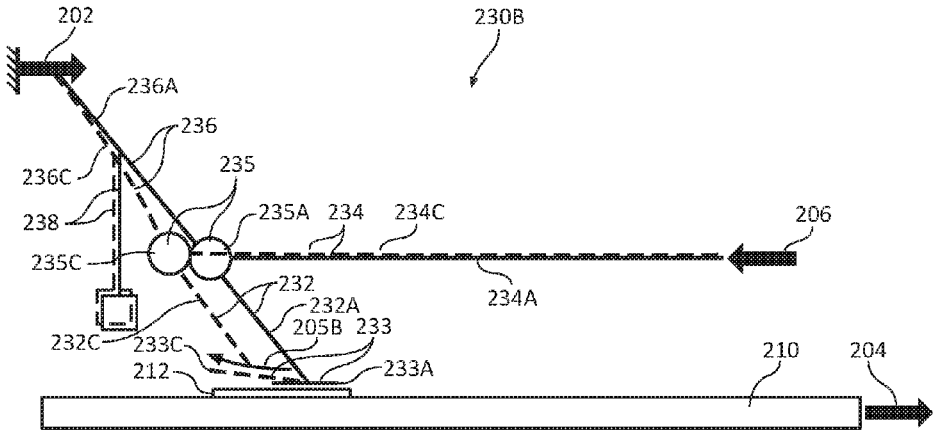
FIG. 3B illustrates a schematic view of a rear hub comprising a stiffening member in a gas turbine engine, in accordance with various embodiments.

In various embodiments, a rear hub 230B may comprise a stiffening member 238 (such as a minibore), as depicted in FIG. 3B. Stiffening member 238 may provide conical web 236 with greater structural strength and/or stiffness. In various embodiments, in response to axial compression force 206 being applied to horizontal arm 234, the components of rear hub 230B may move in a forward direction. Pivot point 235 may be displaced radially and/or axially and assume position 235C. Stiffening member 238 may cause conical web 236 to bend and/or move less in response to axial compression force 206 and/or static force 202 because of the added strength and/or stiffness to conical web 236 from stiffening member 238. Therefore, position 235C may be less of a displacement from position 235A than position 235B. In various embodiments, in response to pivot point 235 assuming position 235C, horizontal arm 234 may move and/or bend axially and/or radially and assume position 234C. Horizontal arm 234 assuming position 234C may be less of a bend and/or displacement from position 234A than position 234B. In various embodiments, hub kickstand 232 may be displaced axially and/or radially and assume position 232C. Hub foot 233, which may be rigidly coupled to hub kickstand 232, may move axially and/or radially and assume position 233C, moving in lifting direction 205B and separating from tie shaft snap 212, in response to pivot point 235 assuming position 235C. Hub foot 233, when in position 233C, may be decoupled from tie shaft 210 and/or tie shaft snap 212, and/or may be partially or completely separated from tie shaft 210 and/or tie shaft snap 212. Hub foot 233 in position 233C may be physically closer to position 233A and tie shaft snap 212 than hub foot 233 in position 233B. In various embodiments, conical web 236 may move and/or bend radially and/or axially and assume position 236C in response to pivot point 235 assuming position 235C. When in position 236C, conical web 236 may assume an arcuate shape, which may be less of an arcuate shape than the arcuate shaped assumed in position 236B.

In various embodiments, a stretch force 204 may be applied to tie shaft 210. Stretch force 204 may be a part of the preload process during gas turbine engine assembly, and may be applied before, after, or simultaneous with the application of compression force 206. By partially or completely separating hub kickstand 232 and/or hub foot 233 from tie shaft 210 and/or tie shaft snap 212, the friction between hub kickstand 232 (and/or hub foot 233) and tie shaft 210 (and/or tie shaft snap 212) may be decreased or eliminated.

During gas turbine engine assembly, tie shaft 210 may be stretched by stretch force 204 and HPC 260 may be compressed by axial compression force 206. A force amount required to overcome the friction between rear hub 230 and tie shaft 210 may be added to axial compression force 206 and/or stretch force 204. The friction force between hub kickstand 232 and tie shaft 212 may be dependent upon a number of variables, such as component geometries, actual fit, actual component surface finish, lubricant properties, and/or the like. Ignoring other variables, stretch force 204 may equal the required compression force 206 plus the friction force between rear hub 230 and tie shaft 210.

In various embodiments, the reduction or elimination of friction may have various benefits. One benefit is that the reduction or elimination of friction may lessen or obviate the need to compensate for friction between rear hub 230 and tie shaft 210 in determining and/or applying the required force levels for axial compression force 206 and/or stretch force 204. Stated another way, less or no additional force will have to be added to axial compression force 206 and/or stretch force 204 to compensate for the friction between hub kickstand 232 and tie shaft 210. Thus, another benefit is that the amount of force required in axial compression force 206 and/or stretch force 204 may be less without that friction. Yet another benefit is that the accuracy of calculating and applying the target force levels for axial compression force 206 and/or stretch force 204 may be increased, because the friction variable, which may be unpredictable and difficult to calculate, is decreased or removed from the calculation. A benefit of the structure of rear hub 230, in addition to the reduction or elimination of friction, is that a desired friction reduction between hub kickstand 232 and tie shaft 212 may be targeted and achieved by varying the geometry and coupling configurations of the components of rear hub 230.

Figure 4:
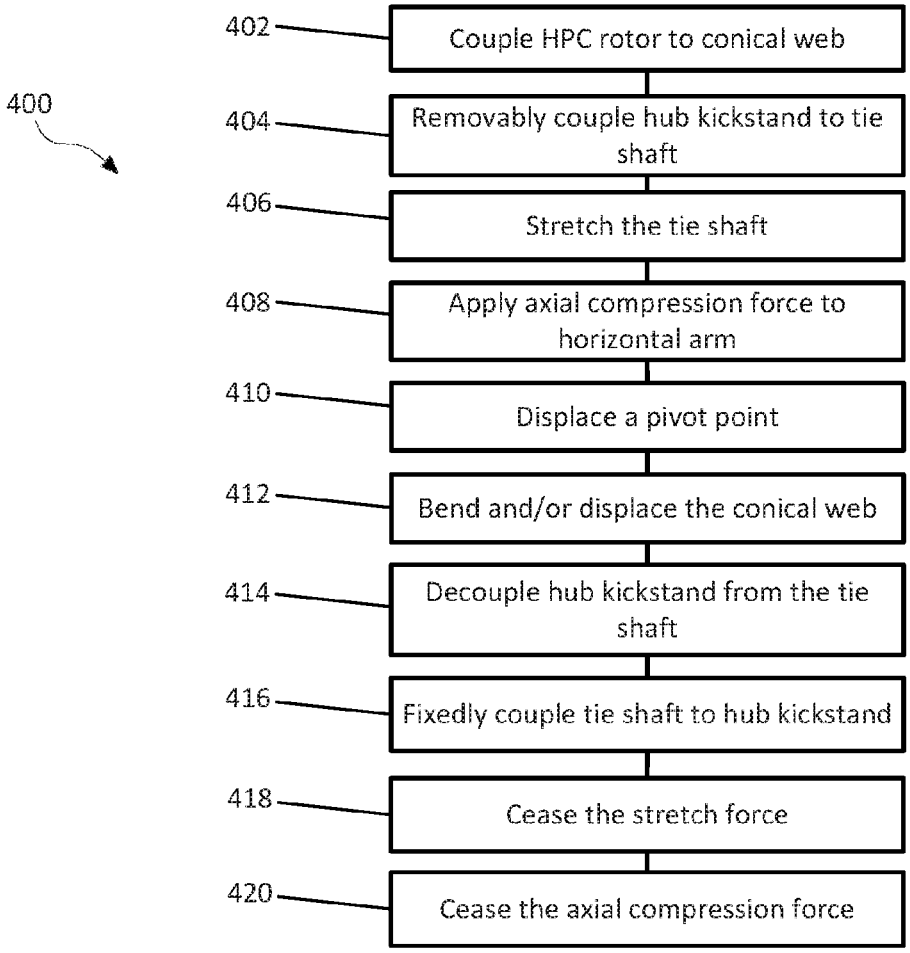
FIG. 4 illustrates a method for assembling a gas turbine engine, in accordance with various embodiments.

FIG. 4 depicts a method for assembling a gas turbine engine 400. The method may reduce friction during the gas turbine engine assembly between a rear hub and a tie shaft. With combined reference to FIGS. 2A, 2B, and 4, in accordance with various embodiments, an HPC rotor (such as aft-most HPC rotor 261) may be coupled to conical web 236 of rear hub 230 (step 402). Hub kickstand 232 may be removably coupled to tie shaft 210 (step 404). Hub kickstand 232 may comprise hub foot 233, and hub foot 233 may be removably coupled to tie shaft 210 and/or tie shaft snap 212.

With combined reference to FIGS. 3A, 3B, and 4, in various embodiments, tie shaft 210 may be stretched (step 406) by stretch force 204. Axial compression force 206 may be applied to horizontal arm 234 (step 408). In response to axial compression force 206, horizontal arm 234 may move and/or be displaced, axially, from position 234A to 234B (or 234C where rear hub 230B comprises stiffening member 238). Pivot point 235 may move or be displaced (step 410) in response to axial compression force 206 being applied to horizontal arm 234. Pivot point 235 may move from position 235A, radially and/or axially, to assume position 235B (or 235C where rear hub 230B comprises stiffening member 238). Conical web 236 may bend and/or be displaced (step 412) radially and/or axially in response to pivot point 235 being displaced. Conical web 236 may move from position 236A to 236B (or 236C where rear hub 230B comprises stiffening member 238). In response to pivot point 235 being displaced to position 235B (or 235C), hub kickstand 232 may move, radially and/or axially, to position 232B (or 235C where rear hub 230B comprises stiffening member 238). Hub kickstand 232 may decouple from tie shaft 210 (step 414) in response to hub kickstand 232 moving to position 232B (or position 232C where rear hub 230B comprises stiffening member 238). In various embodiments, hub foot 233, which may be rigidly coupled to hub kickstand 232, may partially or completely decouple from tie shaft 210 and/or tie shaft snap 212 in response to hub kickstand 232 moving to position 232B (or 232C).

In various embodiments, in response to the decoupling of hub kickstand 232 and tie shaft 210, friction may be reduced or eliminated between hub kickstand 232 and tie shaft 210, which may give rise to the benefits discussed above. Tie shaft 210 may be fixedly coupled to hub kickstand 232 (step 416). The fixed coupling of tie shaft 210 and hub kickstand 232 may be completed by a coupling device, such as coupling nut 215. Stretch force 204 on tie shaft 210 may be ceased (step 418). Axial compression force 206 on horizontal arm 234 may be ceased (step 420), which may cause the displacement of the components of rear hub 230 to cease. Pivot point 235 may return to position 235A, hub kickstand 232 may return to position 232A, and/or horizontal arm 234 may return to position 234A. A residual force may remain on rear hub 230 and/or the rotors stack of HPC 260 after tie shaft is fixedly coupled to hub kickstand 232, and/or after axial compression force 206 and/or stretch force 204 has ceased. The residual force on rear hub 230 and/or the rotors stack of HPC 260 may function to keep the rotors stack compressed in order to maintain friction between the rotors, and ensure transmission of torque along the rotors stack.

Although a rotor and/or rotors stack of a HPC is depicted for illustrative purposes, it should be understood that any rotor and/or rotors stack within a gas turbine engine may incorporate this disclosure, including various turbine and/or compressor rotors and/or rotors stacks.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method for assembling a gas turbine engine, comprising:

coupling a high pressure compressor rotor to a conical web of a rear hub;

removably coupling a tie shaft to a hub kickstand of the rear hub, the hub kickstand being coupled to the conical web;

applying an axial compression force to a horizontal arm of the rear hub, the horizontal arm being coupled to the conical web, sufficient to decouple the kickstand from the tie shaft;

displacing a pivot point, at which the conical web, the horizontal arm, and the hub kickstand converge, axially in response to the applying the axial compression force to the horizontal arm; and decoupling the hub kickstand from the tie shaft in response to the applying the axial compression force to the horizontal arm of the rear hub.

2. The method of claim 1, further comprising stretching the tie shaft.

3. The method of claim 1, further comprising bending the conical web in response to the applying the axial compression force to the horizontal arm.

4. The method of claim 1, wherein the hub kickstand comprises a hub foot that is coupled and decoupled from the tie shaft.

5. The method of claim 1, further comprising ceasing the axial compression force to the horizontal arm.

6. The method of claim 5, further comprising fixedly coupling the tie shaft to the hub kickstand with a coupling nut.

* * * * *